US010215067B2

(12) United States Patent
Hölsch et al.

(10) Patent No.: US 10,215,067 B2
(45) Date of Patent: Feb. 26, 2019

(54) OVERLOAD PROTECTION FOR AN ACTUATOR OF A SYSTEM FOR CONTROLLING SOUND PROPAGATING THROUGH AN EXHAUST SYSTEM

(71) Applicant: Eberspächer Exhaust Technology GmbH & Co. KG, Neunkirchen (DE)

(72) Inventors: Ralf Hölsch, Epfendorf (DE); Michael Pommerer, Uhingen (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 437 days.

(21) Appl. No.: 14/863,531

(22) Filed: Sep. 24, 2015

(65) Prior Publication Data

US 2016/0090885 A1 Mar. 31, 2016

(30) Foreign Application Priority Data

Sep. 25, 2014 (DE) ..... 10 2014 113 940

(51) Int. Cl.
*F01N 1/06* (2006.01)
*G10K 11/178* (2006.01)
*G10K 15/02* (2006.01)

(52) U.S. Cl.
CPC ..... *F01N 1/065* (2013.01); *G10K 11/178* (2013.01); *G10K 11/17825* (2018.01); (Continued)

(58) Field of Classification Search
CPC ..... F02M 35/125; G01K 11/178; G01K 11/1788; G01K 2200/503; G01K 2200/12822; F01N 1/065; F01N 2560/028
See application file for complete search history.

(56) References Cited

U.S. PATENT DOCUMENTS 4,805,733 A * 2/1989 Kato ..... F01N 1/065 181/206
5,097,923 A * 3/1992 Ziegler ..... F01N 1/065 181/206

(Continued)

FOREIGN PATENT DOCUMENTS

DE 10 2012 017832 A1 4/2013
DE 10 2011 117495 A1 5/2013

(Continued)

OTHER PUBLICATIONS

Extended European Search Report dated Feb. 22, 2016.

*Primary Examiner* — John Zaleskas
(74) *Attorney, Agent, or Firm* — McGlew & Tuttle, P.C.

(57) ABSTRACT

A system (70) for actively controlling sound propagating through exhaust systems (40) includes a controller (90), a sound generator (30), in fluid communication with an exhaust system (40), and an actuator (20), inside the sound generator and receiving a controller control signal for generating sound inside the sound generator to reduce sound inside the exhaust system. The controller identifies an increased exhaust pressure inside the exhaust system based on signals output by an error microphone (50), a temperature sensor (51), an impedance measuring bridge (52), a bus system (53), or a water sensor (54). The controller interrupts a generation of the control signal and/or interrupts an output of the control signal to the at least one actuator and/or reduces a level of the control signal output to the at least one actuator by at least 30% or at least 60% upon determining a presence of an excessive exhaust gas pressure.

8 Claims, 2 Drawing Sheets

(52) U.S. Cl.
CPC .. *G10K 11/17833* (2018.01); *G10K 11/17883* (2018.01); *F01N 2560/028* (2013.01); *G10K 15/02* (2013.01); *G10K 2210/12822* (2013.01); *G10K 2210/503* (2013.01); *G10K 2210/51* (2013.01)

(56) References Cited

U.S. PATENT DOCUMENTS 5,222,148 A * 6/1993 Yuan ..... F01N 1/065 381/71.12
5,278,913 A * 1/1994 Delfosse ..... G10K 11/1784 381/71.11
5,321,759 A * 6/1994 Yuan ..... F01N 1/065 381/71.12
5,325,438 A * 6/1994 Browning ..... F01N 1/065 181/206
5,359,662 A * 10/1994 Yuan ..... G10K 11/1786 381/71.12
5,386,472 A * 1/1995 Pfaff ..... F01N 1/065 381/71.12
5,532,649 A * 7/1996 Sahyoun ..... H03F 1/52 330/297
5,571,239 A * 11/1996 Kameda ..... F01N 1/065 123/184.21
5,581,619 A * 12/1996 Shibata ..... G10K 11/178 381/71.11
5,649,016 A * 7/1997 Nagami ..... F01N 1/065 381/71.11
5,692,052 A * 11/1997 Tanaka ..... F01N 1/065 381/71.11
5,809,152 A * 9/1998 Nakamura ..... G10K 11/178 381/71.1
5,850,458 A * 12/1998 Tomisawa ..... G10K 11/1786 381/71.4
7,933,420 B2 * 4/2011 Copley ..... H04R 5/02 381/71.11
8,688,360 B2 * 4/2014 Norden ..... F01N 11/002 180/65.1
2001/0036280 A1 * 11/2001 Astorino ..... G10K 11/178 381/71.4
2001/0036281 A1 * 11/2001 Astorino ..... F01N 1/065 381/71.4
2005/0045134 A1 * 3/2005 Amanuma ..... B60K 6/44 123/179.4
2009/0257599 A1 * 10/2009 Sand Jensen ..... H03F 1/52 381/55
2012/0288111 A1 * 11/2012 Luecking ..... G10K 11/1782 381/71.5
2012/0308023 A1 * 12/2012 Luecking ..... F01N 1/065 381/71.5
2013/0013147 A1 * 1/2013 Luecking ..... F01N 1/065 701/36
2013/0108067 A1 * 5/2013 Schumacher ..... H04R 3/007 381/71.5
2013/0133399 A1 5/2013 Hibino
2014/0274198 A1 9/2014 Miller
2014/0328493 A1 * 11/2014 Wirth ..... H04R 1/028 381/86
2015/0046071 A1 * 2/2015 Clarke ..... B60W 30/18018 701/112

FOREIGN PATENT DOCUMENTS

DE 10 2012 018320 A1 3/2014
DE 10 2013 208186 A1 11/2014
EP 0470656 A1 * 2/1992 ..... F01N 1/065
EP 0916817 A2 * 5/1999 ..... F01N 1/065
EP 2 701 143 A1 2/2014
JP 04019313 A * 1/1992
JP 08246969 A * 9/1996 ..... G10K 11/1788
JP 08254163 A * 10/1996
JP 2000 130145 A 5/2000
JP 2001 280113 A 10/2001
JP 3 655006 B2 6/2005
WO WO 2013076137 A1 * 5/2013 ..... G10K 11/1788

* cited by examiner

OVERLOAD PROTECTION FOR AN ACTUATOR OF A SYSTEM FOR CONTROLLING SOUND PROPAGATING THROUGH AN EXHAUST SYSTEM

CROSS REFERENCE TO RELATED APPLICATIONS

The present application claims priority of Patent Application No. DE 10 2014 113 940.2, filed Sep. 25, 2014 in Germany, the entire contents of which are incorporated by reference herein.

FIELD

The invention relates to a protection of an actuator from mechanical overload, the actuator forming part of a system designed for controlling sound propagating through an exhaust system of a vehicle driven by an internal combustion engine.

BACKGROUND

Exhaust systems for internal combustion engines are typically built from passive components through which the exhaust gas passes in all operational situations and which, as a whole, form the exhaust system. In addition to pipes, a turbocharger, a catalytic converter or a muffler may also form such a component.

In recent years, systems have been added to exhaust systems allowing an active control of sound resulting from an operation of an internal combustion engine and propagating through the exhaust system. Respective systems impart a characteristic noise emission to the exhaust noise generated by the internal combustion engine and propagating through the exhaust system that is believed to fit the image of a respective manufacturer and to be popular with customers. For this purpose, synthesized sound waves are made to interfere with sound waves (exhaust noise) propagating through an exhaust system and originating from an operation of an internal combustion engine.

This is achieved by providing a sound generator being in fluid communication with the exhaust system for transferring sound into the interior of the exhaust system. The synthesized sound interferes with the sound generated by the internal combustion engine and together both sounds are then discharged through a tailpipe of the exhaust system. Respective systems may also be used for sound muffling.

For achieving a complete destructive interference between the sound waves of the exhaust noise propagating through the exhaust system and the sound synthesized by the sound generator, the sound waves originating from the loudspeaker have to match the sound waves propagating through the exhaust system in amplitude and frequency with a relative phase shift of 180 degrees. If the sound waves generated at the loudspeaker match the sound waves of the exhaust noise propagating through the exhaust system in frequency with a phase shift of 180 degrees relative to each other, but not in amplitude, only an attenuation of the sound waves of the exhaust noise propagating through the exhaust system will be achieved.

A system for actively controlling sound propagating through the exhaust system will be described below with reference to FIGS. 1 and 2.

An exhaust system 4 including a system 7 for actively controlling sound propagating through the exhaust system 4 comprises a sound generator 3 formed by a sound proof enclosure housing a loudspeaker 2 and being coupled to the exhaust system 4 in the region of its tailpipe 1 by an acoustic duct. The tailpipe 1 comprises a discharge opening 8 for discharging exhaust gas flowing through the exhaust system 4 and airborne sound propagating through the exhaust system 4 to the exterior. An error microphone 5 is provided at the tail pipe 1. Sound inside the tail pipe 1 is measured using the error microphone 5. The error microphone 5 effects the measurement in a section downstream of a region where the acoustic duct opens into the exhaust system 4 and thus provides the fluid communication between the exhaust system 4 and the sound generator 3. The term "downstream" hereby means the direction of flow for the exhaust gas within the tailpipe 1 of the exhaust system 4. In FIG. 2, arrows illustrate the direction of flow for the exhaust gas. Further components (not shown) of the exhaust system 4, such as a catalytic converter and a muffler, may be provided in-between the region providing a fluid communication between the exhaust system 4 and the sound generator 3, and the internal combustion engine 6. Loudspeaker 2 and error microphone 5 are each coupled to a controller 9. The controller 9 is further coupled to an engine control unit 6' of an internal combustion engine 6 by a CAN bus. The internal combustion engine 6 comprises an intake system 6". Based on the sound measured with the error microphone 5 and the operating parameters of the internal combustion engine 6 received via the CAN bus, the controller 9 computes a control signal for loudspeaker 2 to provide the desired final sound by interference with the sound propagating through the interior of the exhaust systems's 4 tailpipe 1, and supplies the control signal to loudspeaker 2. The controller may hereto use, for example, a Filtered-x, Least Mean Squares (FxLMS) algorithm and try to emit sound using the loudspeaker for reducing the error signal obtained with the error microphone down to zero (sound cancelling) or to a preset threshold value (sound control).

A drawback the above system for actively controlling sound propagating through exhaust systems is the susceptibility of the actuators (like voice coil loudspeakers) used in the sound generators for generating sound to mechanical overload. Due to the sound pressures the actuators need to provide, the actuators are already subject to high mechanical stress when operated under normal conditions. Exhaust gas flowing through the exhaust system and hitting the actuators adds to the stress. The exhaust gas flowing through the exhaust system is usually discharged through the tailpipe's discharge opening so that the pressure acting on the actuators because of the exhaust gas flowing through the exhaust system will not be too high. In case of the discharge opening of the tailpipe being temporarily or permanently plugged (which may be the case when splashing through a puddle or passing through a snowdrift, or when a part of a passive muffler's roving fiberglass insulation comes off), the total pressure of the exhaust gas flowing through the exhaust system will act on the actuators. This may damage the actuators permanently thereby destroying them. The actuators used in a sound generator are also susceptible to thermal overload, which will not be dealt with in the present document.

For preventing mechanical or thermal damaging of an actuator of a system for actively controlling sound propagating through exhaust systems it is, for instance, known from DE 10 2011 117 495.1 to modify a control signal supplied to an actuator such that the control signal may operate the actuator without any risk of damage to the actuator. A mathematical model of the actuator is used for this purpose. This state-of-the-art approach is, however, only adapted to prevent the actuator from being overloaded solely by the control signal itself, but not to inhibit an overloading of the actuator due to excessive exhaust gas pressure inside the exhaust system.

SUMMARY

The present invention is directed to providing a system for actively controlling sound propagating through exhaust systems, which obviates the risk of mechanically damaging an actuator used in the system for generating sound due to excessive exhaust gas pressure inside the exhaust system.

Embodiments of a system for actively controlling sound propagating through an exhaust system comprise a controller, at least one sound generator, and at least one actuator. The sound generator is configured for being arranged in fluid communication with the exhaust system. The at least one actuator is positioned within the at least one sound generator, and is coupled to the controller for receiving control signals. Each sound generator may house one or more actuators. The at least one actuator is further configured to generate sound in the sound generator based on a control signal received from the controller. The controller is configured to generate a control signal and to output the control signal to the at least one actuator. The control signal is adapted to cancel the sound propagating through the interior of the exhaust system at least in part or completely when the at least one actuator is operated using the control signal.

According to an embodiment that may also be combined with each of the embodiments below, the system further comprises an error microphone coupled to the controller and configured for being disposed, with respect to the exhaust gas flow, at a location in the region of the fluid communication between the sound generator and the exhaust system. "At a location in the region of the fluid communication between the sound generator and the exhaust system" hereby means that the location where the fluid communication is implemented and the sound is canceled at least in part is, with respect to the flow direction of the exhaust gas and along the flow direction of the exhaust gas, spaced from the error microphone by not more than ten times, and in particular not more than five times, and further in particular by not more than twice the maximum diameter of the exhaust system at the location where the sound is measured using the error microphone. The error microphone is configured to measure sound inside the exhaust system and to output a corresponding measurement value to the controller. The controller is further configured to interrupt a generation of the control signal and/or an output of the control signal to the at least one actuator and/or to reduce a level of the control signal output to the at least one actuator by at least 30% or at least 60%, when a mean value of the measurement values output by the error microphone over a time period of at least 0.2 seconds is above a preset sound threshold value by at least 5% or at least 10%.

An increased exhaust gas pressure varies the signal output from the error microphone such that the mean value of the measurement values obtained over a time period of at least 0.2 seconds is increased with respect to the mean value of the measurement values obtained over a time period of at least 0.2 seconds at normal pressure. According to this, an indication of an exhaust pressure variation may become accessible using only an often already present error microphone, and thus without any additional components. This allows to generate and output the control signal to the at least one actuator based on the exhaust gas pressure. This way, a mechanical overload of the actuator at too high an exhaust gas pressure may, for instance, be avoided by refraining from further mechanical stress through application of the control signal or by reducing a level of the control signal.

According to an embodiment that may also be combined with each of the embodiments above and below, the system further comprises a temperature sensor coupled to the controller and configured for being disposed in the exhaust system. The temperature sensor is configured to measure the temperature of the exhaust gas flowing through the exhaust system and to output a corresponding measurement value to the controller. The controller is then further configured to interrupt a generation of the control signal and/or an output of the control signal to the at least one actuator and/or to reduce a level of the control signal output to the at least one actuator (20) by at least 30% or at least 60%, when the temperature of the exhaust gas flowing through the exhaust system measured with the temperature sensor increases or decreases by more than 10° C. per second or by more than 20° C. per second.

The temperature inside the exhaust track increases instantly upon preventing or only varying the discharge of the exhaust gas. According to this, an indication of an exhaust pressure variation may become accessible using only an often already present temperature sensor, and thus without any additional components. This allows to generate and output the control signal to the at least one actuator based on the exhaust gas pressure. This way, a mechanical overload of the actuator at an excessive exhaust gas pressure may, for instance, be avoided by refraining from further mechanical stress through application of the control signal or by reducing a level of the control signal. Furthermore, the temperature in the exhaust tract decreases instantly upon water being introduced into the exhaust system (e.g. when crossing a river bed). Also, in this case, mechanical overloading of the actuator may be reduced by refraining from further mechanically stressing the actuator through application of the control signal or by reducing the level of the control signal.

According to an embodiment that may also be combined with each of the embodiments above and below, the system further comprises an impedance measuring bridge coupled to the controller and an actuator. The impedance measuring bridge is configured to measure the electrical impedance of the at least one actuator and to output a corresponding measurement value to the controller. The impedance measuring bridge may be formed integrally with the controller, i.e., the impedance measuring bridge and the controller may be implemented as separate units or an integral unit. The controller is further configured to interrupt a control signal generation and/or an output of the control signal to the at least one actuator and/or to reduce a level of the control signal output to the at least one actuator by at least 30% or at least 60%, when the actuator impedance as determined by the impedance measuring bridge differs from a preset impedance threshold by more than 5% or by more than 10%. The impedance may be the electrical impedance of the actuator or the acoustical impedance of the actuator. The electrical impedance may be obtained directly using a separate impedance measuring bridge or an impedance measuring bridge formed integrally with the controller. The acoustic impedance may be determined by the controller by, for example, comparing the control signals output to the at least one actuator with the signals measured by an error microphone. The impedance threshold of the impedance may be identified empirically. To this end, different impedance threshold values may be specified for different operating conditions of the internal combustion engine supplying the exhaust system with exhaust gas.

An actuator's impedance depends on the emission characteristics of the actuator. The emission characteristics change with the exhaust system being plugged. An impedance variation may be identified with the controller or a separate or an integrated impedance measuring bridge. This way, it is possible to identify a partial or complete plugging of the exhaust system indicating an increased exhaust gas pressure without additional components or with an additional impedance measuring bridge. This enables performing a generation and outputting of the control signal to the at least one actuator based on the exhaust gas pressure. This way, a mechanical overload of the actuator at an excessive exhaust gas pressure may, for instance, be avoided by refraining from further mechanical stress through application of the control signal or by reducing a level of the control signal.

According to an embodiment that may also be combined with each of the embodiments above and below, the system further comprises a bus system coupled to the controller and configured for being coupled to an engine control unit of an internal combustion engine. The bus system is configured to receive an internal combustion engine's speed value output from the engine control unit and/or a torque value of the internal combustion engine and to output these to the controller. The controller is further configured to interrupt a control signal generation and/or an output of the control signal to the at least one actuator and/or reduce a level of the control signal output to the at least one actuator by at least 30% or at least 60%, when the engine speed received from the controller via the bus system and the torque of the internal combustion engine indicate that a currently present exhaust gas back pressure exceeds the preset exhaust gas back pressure threshold by more than 10% or more than 30%. From the engine speed and torque, a mass flow can be obtained, for which an exhaust gas backpressure specific for a respective exhaust system may be stored in the controller. In the simplest case, the bus system may be an interface for a bus system.

An internal combustion engine's engine key figures, and in particular engine speed and torque, vary with an exhaust gas backpressure's variation in a characteristic manner. A controller can identify a respective variation. A mathematical model of the exhaust system and the internal combustion engine may be employed hereto. The mathematical model may be determined empirically. According to this a variation of the exhaust pressure may be identified without additional components. This enables generation and output of the control signal to the at least one actuator based on the exhaust gas pressure. This way, a mechanical overload of the actuator at an excessive exhaust gas pressure may, for instance, be avoided by refraining from further mechanical stress through application of the control signal or by reducing a level of the control signal.

According to an embodiment that may also be combined with each of the embodiments above, the system further comprises a water sensor coupled to the controller and configured for being mounted to the exhaust system in a region of its tail pipe. The water sensor is configured for sensing the tail pipe being immersed into water and to output a corresponding signal. Respective water sensors are also referred to as a flooding sensor and consist in the simplest case of two open contacts between which an electrical resistance is measured. The controller is further configured to interrupt an control signal generation and/or an output of the control signal to the at least one actuator and/or to reduce a level of the control signal output to the at least one actuator by at least 30% or at least 60%, when the signal output from the water sensor indicates that the tail pipe of the exhaust system is immersed into water.

An immersion of an exhaust system's tail pipe into water occurs, for instance, when a vehicle drives through water or when a vehicle is used to launch a water vehicle, and represents an operational condition resulting in a significantly increasing exhaust gas back pressure inside the exhaust system of the vehicle. Said operating condition can be identified reliably using the water sensor. Upon identifying said operational condition, a mechanical overload of the actuator may, for instance, be avoided by refraining from further mechanical stress through application of the control signal or by reducing a level of the control signal.

According to an embodiment, the controller is configured to reduce the level of the control signal output to the at least one actuator by varying amplitude and/or frequency of the control signal. The controller allows this without any problem, since the controller is already configured to determine the appropriate control signal for the at least one actuator at each operating condition. Any frequency variation results in a significant variation of the noise output at the tail pipe. This helps in indicating an increase in the exhaust gas backpressure and thus a possible plugging of the exhaust system to a user.

Since the controller often composes the control signal output from the controller to the at least one actuator from several sine oscillations, the level of the control signal output to the at least one actuator may additionally or alternatively also be reduced by varying the phases of the individual sine oscillations forming the control signal. The controller allows this without any problem, since the controller is already configured to determine the appropriate control signal for the at least one actuator at each operating condition.

According to an embodiment, the water sensor and/or the temperature sensor are not directly coupled to the controller but indirectly via a bus system coupling the controller to an engine control unit of an internal combustion engine. This enables other components of the vehicle to use the signals output from the water sensor or the temperature sensor.

The controller, that is configured to generate the control signal adapted to at least partially or completely cancel sound propagating inside the exhaust system, also interrupts the generation of the control signal, interrupts the output of the control signal or reduces the level of the control signal upon the controller determining that there is a state of actuator overload or harm or more particularly the presence of an excessive exhaust gas pressure. In particular, the system employs an actuator overload or harm sensor or indicator to generate a signal indicating (capable of sensing or indicating) actuator overload or harm. This sensor or indicator may particularly sense or indicate (be capable of sensing or indicating) a presence of an excessive exhaust gas pressure. The sensing or indicating may be a provided as a signal, wherein the controller determines the overload or harm state or the presence of an excessive exhaust gas pressure by an evaluation of the signal such as by a comparison of the signal or signal value to a threshold or by evaluating a rate of change of the signal or signal value. This allows a determination as to whether the signal represents the presence of a state of actuator overload or harm or more particularly represents a presence of an excessive exhaust gas pressure. The actuator overload or harm sensor or indicator or the excessive exhaust gas pressure sensor or indicator may be one or more of the error microphone, the temperature sensor, the impedance measuring bridge, the bus system and the water sensor or other features to sense or indicate a state of actuator overload or harm or a presence of an excessive exhaust gas pressure.

According to an embodiment, the actuator is a voice coil loudspeaker.

According to an embodiment, the sound generator is a clam-shell case made from sheet metal.

According to an embodiment, a bell mouth supports the voice coil loudspeaker disposed within a sound generator in the form of a clam-shell sheet metal case.

Embodiments of a motor vehicle comprise an internal combustion engine having an engine control unit, an intake system and an exhaust system in fluid communication with the internal combustion engine, and a system as described above. The system's at least one sound generator is hereby in fluid communication with the exhaust system. The controller of the system is further coupled to the engine control unit of the vehicle's internal combustion engine, for instance via a bus system.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION

Figure 1:
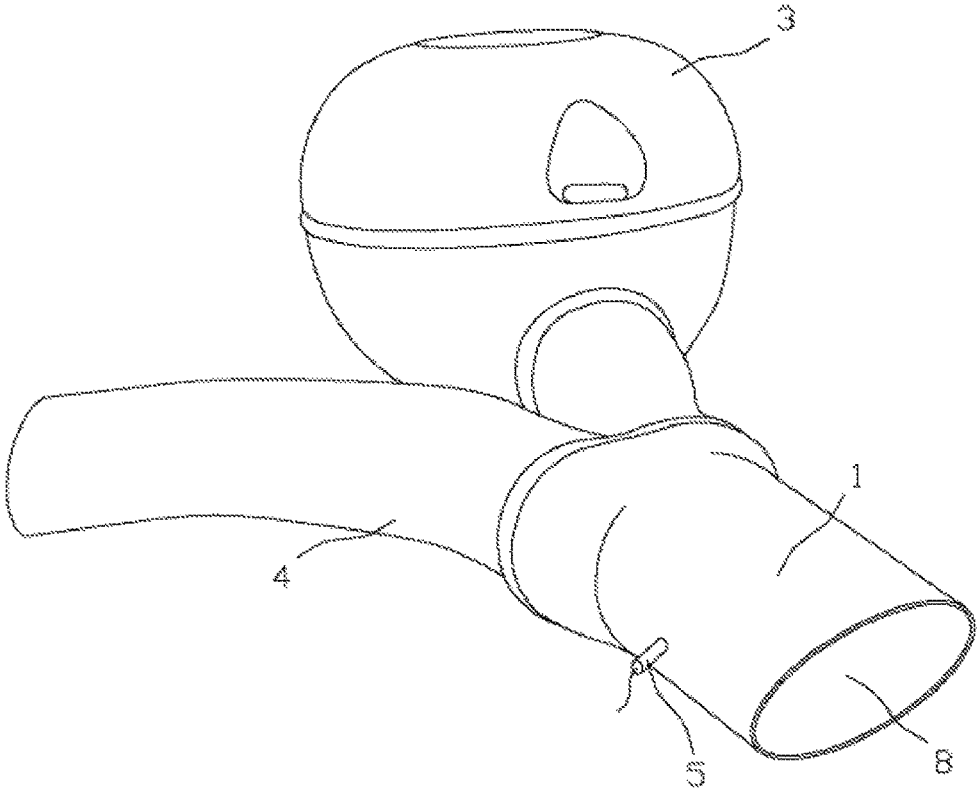
FIG. 1 is a schematic perspective view of a sound generator and part of a comparative exhaust system that may also be used with the present invention.
Figure 2:
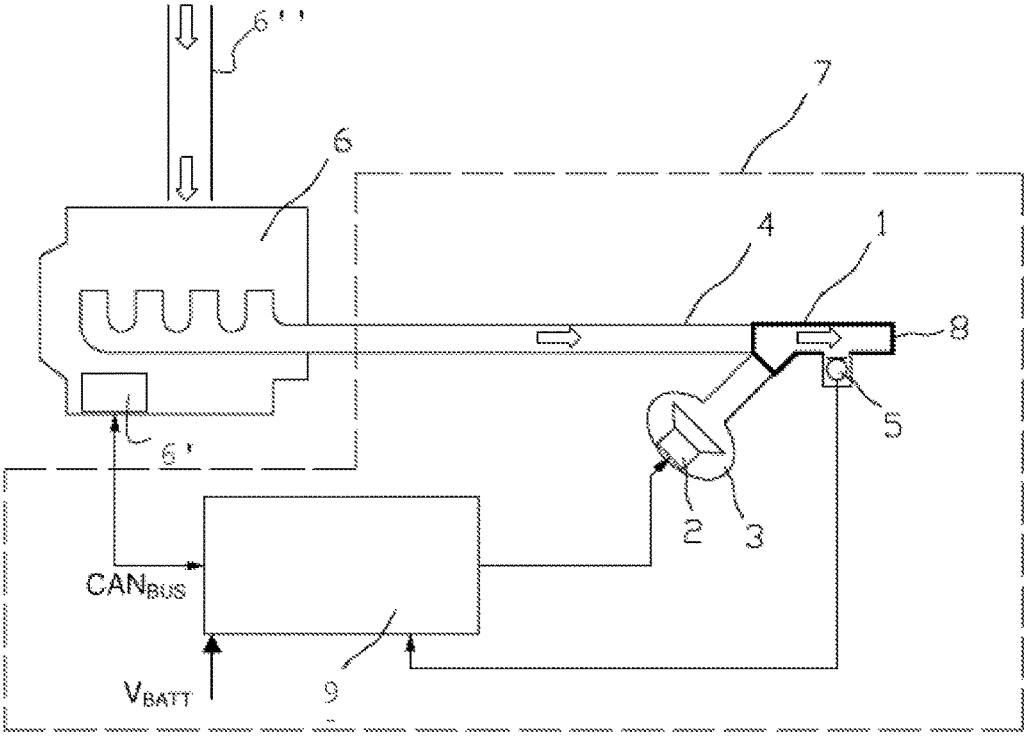
FIG. 2 is a schematic block diagram of a comparative system for controlling sound propagating through the exhaust system.

Referring to the drawings, in the exemplary embodiments described below, components that are alike in function and structure are designated as far as possible by alike reference numerals. Therefore, to understand the features of the individual components of a specific embodiment, the descriptions of other embodiments and of the summary of the disclosure should be referred to.

Referencing FIG. 3, an embodiment of a system 70 for actively controlling sound propagating through an exhaust system 40 will be described below.

Figure 3:
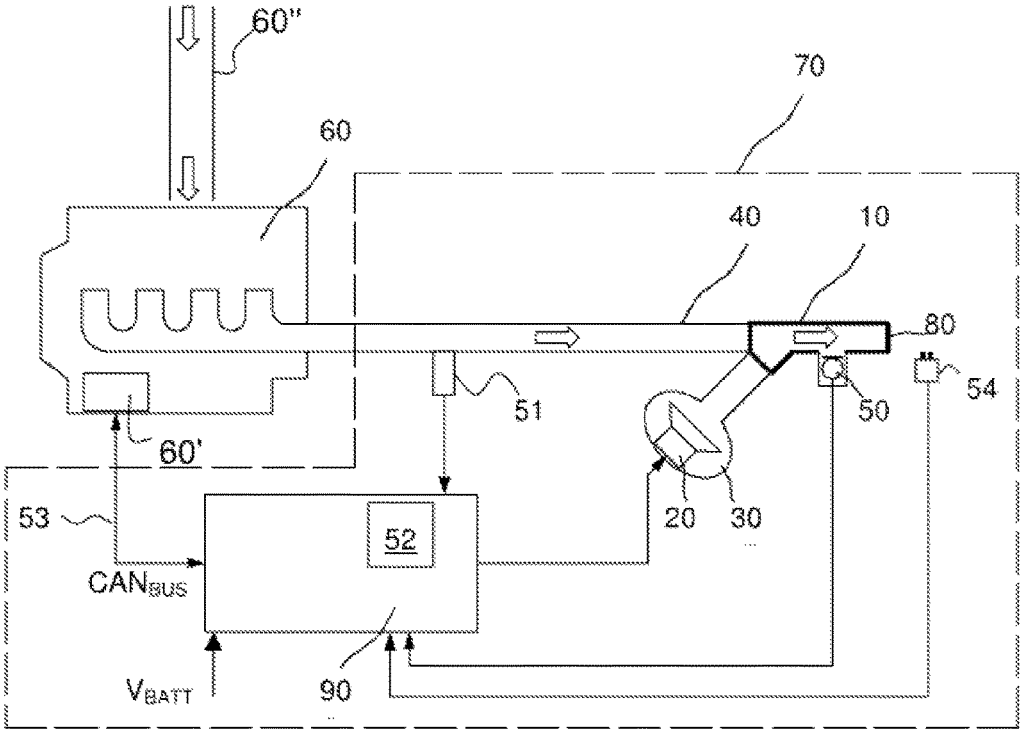
FIG. 3 is a schematic block diagram of a system for controlling sound propagating through the exhaust system according to an embodiment of the invention.

As shown in FIG. 3, an internal combustion engine 60 is coupled to an intake system 60" for an intake of fresh air for carburation and to an exhaust system 40 for discharging exhaust gas formed in the internal combustion engine 60. Both, the intake system 60" and the exhaust system 40 are only shown schematically. In particular, a filter may be part of the intake system 60". The exhaust system 40 may, in particular, also comprise active or passive mufflers, catalytic converters, and filters. Arrows in FIG. 3 indicate the flow directions of fresh air and exhaust gas.

The functioning of the internal combustion engine 60 is controlled and monitored by engine control unit 60'. Although in FIG. 3, the engine control unit 60' is located directly at the internal combustion engine 60, this need not necessarily be the case. Thermal considerations may instead advocate spacing the engine control unit further away from the internal combustion engine.

A sound generator 30 is coupled to the exhaust system 40 in the region of the exhaust system's 40 tail pipe 10, whereby the tail pipe 10 has a discharge opening 80 formed therein. In the embodiment shown, the sound generator 30 is coupled to the exhaust system 40 using a Y-pipe and a short pipe section for achieving a certain thermal isolation between the sound generator 30 and the exhaust gas flowing through the exhaust system 40. Since the exhaust gas is stationary at the region of the sound generator 30 and the pipe section coupling the sound generator 30 to the exhaust system 40, the exhaust gas temperature in this region is significantly lower than in other regions of the exhaust system 40. Exhaust gas flowing through the exhaust system 40 is discharged through the discharge opening 80 to the outside.

The sound generator is a clam-shell (two part) sheet metal case substantially impervious to water and airtight with an actuator formed by a voice coil loudspeaker 20 disposed inside the case. The expression "substantially impervious to water and airtight" does hereby not exclude any presence of a pressure equalizing valve enabling, like a throttle, a gentle equalization of the sound generator's internal pressure to ambient pressure.

The voice coil loudspeaker 20 is coupled to a controller of the system 70 via a control line, the controller being implemented in form of a microprocessor 90.

Further, an error microphone 50 is disposed between the discharge opening 80 and the position inside the tail pipe 10 where the sound generator 30 is in fluid communication with the exhaust system 40, the error microphone 50 being coupled to the exhaust system 40 via a flexible line. The error microphone 50 measures sound inside the tail pipe 10 and outputs a corresponding measuring value to microprocessor 90. Further, a temperature sensor 51 is coupled to the exhaust system, the temperature sensor 51 measuring the temperature of the exhaust gas flowing through the exhaust system 40 and outputting a corresponding measuring value to the microprocessor 90 via a control line. A water sensor 54 is further disposed in a region of the tail pipe's 10 discharge opening 80 and also coupled to the microprocessor 90 via a control line. The water sensor 54 detects any immersion of the tail pipe 10 into water and outputs a corresponding signal to the microprocessor 90. Finally, an impedance measuring bridge 52 is incorporated into microprocessor 90 for determining an electrical impedance of the voice coil loudspeaker 20. It is noted that the impedance measuring bridge may alternatively also be implemented as a device separate from microprocessor 90.

The microprocessor 90 further comprises a power supply, represented in FIG. 3 as $V_{Batt}$, with the microprocessor 90 being coupled to the engine control unit 60' via a CAN bus 53 and thus adapted for exchanging data with the engine control unit 60' via CAN bus 53. In particular, the microprocessor 90 receives from the engine control unit 60' for each operating state of the internal combustion engine 60 a current engine speed value and a corresponding torque value. Although the above data exchange between microprocessor 90 and engine control unit 60' is described using a CAN bus 53, the invention is not limited to the use of a particular bus. Instead, any type of data bus enabling a data exchange such as described above may be used.

Although the microprocessor 90 and the engine control unit 60' have been described above to be separate units, the invention is not limited thereto. The microprocessor 90 may alternatively be incorporated within the engine control unit 60'. In this case, the bus system between microprocessor 90 and engine control unit 60' can be dispensed with.

The functionality of the system 70 for actively controlling sound propagating through an exhaust system 40 illustrated in FIG. 3 will be explained below.

The microprocessor 90 generates a control signal based on an engine speed value and a torque value of the internal combustion engine 60 received from the engine control unit 60' via the CAN bus 53 using a Filtered-x, Least Mean Squares (FxLMS) algorithm, and outputs the control signal to the voice coil loudspeaker 20. The control signal is adapted to partially cancel sound propagating through the interior of the exhaust system 40 in the region of the tail pipe 10 by having the voice coil loudspeaker 20 generating sound based on the control signal. Sound generated by the voice coil loudspeaker 20 is launched into the tail pipe 10 using the fluid communication between the sound generator 30 and the exhaust system 40 where it interferes with sound from the internal combustion engine 60 passing the exhaust system 40 together with the exhaust gas.

The microprocessor 90 is further adapted to determine a current impedance of the voice coil loudspeaker 20 using the integrated impedance measuring bridge 52 at any one time. If the microprocessor 90 determines that the measured electrical impedance differs from an impedance threshold, which is subject to the respective voice coil loudspeaker 20 used, by more than 5%, the microprocessor 90 automatically terminates any output of the control signal to the voice coil loudspeaker 20 thereby disabling the voice coil loudspeaker 20.

The microprocessor 90 is further adapted to determine an exhaust gas back pressure respectively resulting from the engine speed and torque values of the internal combustion engine 60 received via the CAN bus 53 using a mathematical model of the internal combustion engine 60 and the exhaust system 40. If the thus calculated exhaust gas back pressure differs from the exhaust gas back pressure threshold that is determined empirically and preset as standard for the respective engine speed of the internal combustion engine 60 by more than 10% to higher values, the microprocessor 90 is further adapted to terminate the output of the control signal to the voice coil loudspeaker 20.

The microprocessor 90 also automatically terminates the output of the control signal to the voice coil loudspeaker 20, when the signal output from the water sensor 54 indicates that the discharge opening 80 of the tail pipe 10 is immersed into water.

The error microphone 50 serves for one to measure the sound event resulting from the noise generated with the voice coil loudspeaker 20 interfering with the exhaust gas noise propagating through the exhaust system 40 and to output it to the microprocessor 90. The microprocessor 90 uses this feedback noise from the error microphone 50 to create the control signal for the voice coil loudspeaker 20.

The error microphone 50 further enables the microprocessor 90 to determine a respective acoustic impedance of the voice coil loudspeaker 20, because the error microphone 50 also detects the noise generated by the voice coil loudspeaker 20 in response to a respective control signal. This is possible, because the noise generated by the internal combustion engine 60 is known for each engine speed and each torque and each exhaust system on an empirical basis. If the microprocessor 90 hereby identifies that the acoustic impedance thus determined differs from a preset impedance threshold by more than 5%, an output of the control signal to the voice coil loudspeaker 20 will again be terminated. The preset impedance threshold may also be determined empirically.

The microprocessor 90 is further adapted to suppress an output of the control signal to the voice coil loudspeaker 20, upon the temperature sensor 51 indicating an increase or decrease of the exhaust gas temperature measured inside the exhaust system 40 of more than 20° C. per second.

The microprocessor 90 is finally adapted to interrupt the output of the control signal to the loudspeaker 20, when a mean value of the measurement values output by the error microphone 50 over a time period of at least 0.3 seconds is above an empirically determined preset sound threshold by at least 5%.

Although in the above embodiment, the microprocessor 90 only interrupts the output of the control signal to the voice coil loudspeaker 20, it is of course alternatively possible to already interrupt the generation of the control signal. Alternatively it is also possible not to interrupt the generation and output of the control signal to the voice coil loudspeaker 20, but to manipulate the control signal itself such that the displacement of the voice coil loudspeaker's 20 membrane effected by the control signal received is reduced. The level of the control signal may hereto, for example, be reduced by 30% or more. This may, for instance, be effected by reducing the amplitudes. Alternatively or additionally it is also possible to vary the control signal's frequency such that in sum a lower control signal level is achieved.

Although a multiplicity of factors (measuring value of the error microphone, measuring value of the temperature sensor, measuring value of the impedance measuring bridge, torque and engine speed value received from the engine control unit, signal from the water sensor) are present that each may individually cause the microprocessor 90 to interrupt an output of the control signal to the voice coil loudspeaker 20, it is noted that these factors may cause the microprocessor 90 to interrupt an output of the control signal to the voice coil loudspeaker 20 either alternatively or cumulatively. By interrupting the output of the control signal to the voice coil loudspeaker 20 only then, when more of the above factors indicate an interruption of the control signal output, an unnecessary interruption of the control signal output to the voice coil loudspeaker may be avoided, when the exhaust gas back pressure present in the exhaust system 40 is actually not that high. An interruption of the output of the control signal to the voice coil loudspeaker may for instance require that two, three, four, five or even all six of the above factors have to be met cumulatively.

Although FIG. 3 shows a control line coupling the water sensor 54 directly to the microprocessor 90, this is not mandatory. Alternatively, the CAN bus 53 may also connect the water sensor 54 to both the engine control unit 60' and the microprocessor 90. This is also true for the temperature sensor 51.

Although the invention has been described above based on a single flow exhaust system, the invention is not limited thereto.

Although the control signal for the voice coil loudspeaker 20 generated by microprocessor 90 is formed as described above to partially cancel sound propagating through the exhaust system, the present invention is not limited thereto. The sound propagating through the exhaust system may alternatively also be cancelled completely or be manipulated such that a desired target noise is emitted through the discharge opening 80 of the tail pipe 10, whereby the target noise may vary with a current engine speed and/or a current torque of the internal combustion engine 60.

Figure 4:
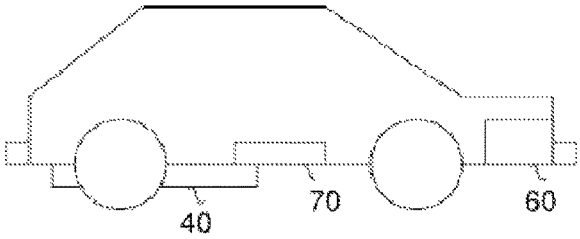
FIG. 4 is a schematic representation of a motor vehicle driven by an internal combustion engine and using the system from FIG. 3.

Below, a passenger car driven by an internal combustion engine is described referencing FIG. 4.

The passenger car comprises an internal combustion engine 60 with an integrated engine control unit 30 as shown in FIG. 3. The internal combustion engine is in fluid communication with the intake system 60" and the exhaust system 40 shown in FIG. 3. The sound generator 30 of the system 70 from FIG. 3 is in fluid communication with the exhaust system 40. The microprocessor 90 of system 70 is coupled to the engine control unit 60' of the internal combustion engine. This way it is possible to partially or completely cancel the noise having its origin in the internal combustion engine 60 and being emitted by the passenger car.

While the disclosure has been described with respect to certain exemplary embodiments thereof, it is evident that many alternatives, modifications and variations will be apparent to those skilled in the art. Accordingly, the exemplary embodiments of the disclosure set forth herein are intended to be illustrative and not limiting in any way. Various changes may be made without departing from the spirit and scope of the present disclosure as defined in the following claims. While specific embodiments of the invention have been shown and described in detail to illustrate the application of the principles of the invention, it will be understood that the invention may be embodied otherwise without departing from such principles.

What is claimed is:

1. A sound propagation control system for actively controlling sound propagating through an exhaust system, the sound propagation control system comprising:

a sound generator to be in fluid communication with the exhaust system;

an actuator disposed inside the sound generator;

an actuator overload or harm sensor or indicator to generate a signal indicating actuator overload or harm;

a controller operatively connected to the actuator overload or harm sensor or indicator and operatively connected to the actuator, the actuator receiving a control signal from the controller and being configured to generate sound in the sound generator based on the control signal received from the controller, the controller being configured to generate the control signal and to output the control signal to the actuator, the control signal being adapted to at least partially or completely cancel sound propagating inside the exhaust system when the actuator generates sound in the sound generator based on the control signal received from the controller, the controller being further configured to receive the signal indicating actuator overload or harm and in response to determine actuator overload or harm and based on the determination of actuator overload or harm at least one of:

to interrupt a generation of the control signal;

to interrupt an output of the control signal to the actuator; and to reduce a level of the control signal output to the actuator by at least 30%, wherein:

the actuator overload or harm sensor or indicator comprises a temperature sensor coupled to the controller and configured for being disposed inside the exhaust system, the temperature sensor being configured to measure a temperature of the exhaust gas flowing through the exhaust system, and to output a respective measuring value to the controller as the signal indicating actuator overload or harm; and the controller is configured to determine actuator overload or harm if the temperature of the exhaust gas flowing through the exhaust system measured with the temperature sensor increases by more than 20° C. per second.

2. The sound propagation control system according to claim 1, further comprising an internal combustion engine, wherein the exhaust system comprises an exhaust structure located downstream of the internal combustion engine with respect to a flow of exhaust gas, wherein the sound propagating through the exhaust structure is controlled via the controller.

3. A sound propagation control system for actively controlling sound propagating through an exhaust system, the sound propagation control system comprising:

a sound generator to be in fluid communication with the exhaust system;

an actuator disposed inside the sound generator;

an actuator overload or harm sensor or indicator to generate a signal indicating actuator overload or harm;

a controller operatively connected to the actuator overload or harm sensor or indicator and operatively connected to the actuator, the actuator receiving a control signal from the controller and being configured to generate sound in the sound generator based on the control signal received from the controller, the controller being configured to generate the control signal and to output the control signal to the actuator, the control signal being adapted to at least partially or completely cancel sound propagating inside the exhaust system when the actuator generates sound in the sound generator based on the control signal received from the controller, the controller being further configured to receive the signal indicating actuator overload or harm and in response to determine actuator overload or harm and based on the determination of actuator overload or harm at least one of:

to interrupt a generation of the control signal;

to interrupt an output of the control signal to the actuator; and to reduce a level of the control signal output to the actuator by at least 30%, wherein:

the actuator overload or harm sensor or indicator comprises a bus system coupled to the controller and configured for being coupled to an engine control unit of an internal combustion engine, the bus system being configured to output at least one of an engine speed value output from the engine control unit and a torque value output from the engine control unit of the internal combustion engine to the controller; and the controller is configured to determine actuator overload or harm if the engine speed value output or the torque value output of the internal combustion engine received by the controller via the bus system indicates that the exhaust gas back pressure exceeds a preset exhaust gas back pressure threshold value by more than 20%.

4. The sound propagation control system according to claim 3, further comprising an internal combustion engine, wherein the exhaust system comprises an exhaust structure located downstream of the internal combustion engine with respect to a flow of exhaust gas through the exhaust system, wherein the sound propagating through the exhaust structure is controlled via the controller.

5. The sound propagation control system according to claim 4, wherein the sound generator is located downstream of the internal combustion engine with respect to the exhaust gas flow.

6. A sound propagation control system for actively controlling sound propagating through an exhaust system, the sound propagation control system comprising:

a sound generator to be in fluid communication with the exhaust system;

an actuator disposed inside the sound generator;

an actuator overload or harm sensor or indicator to generate a signal indicating actuator overload or harm;

a controller operatively connected to the actuator overload or harm sensor or indicator and operatively connected to the actuator, the actuator receiving a control signal from the controller and being configured to generate sound in the sound generator based on the control signal received from the controller, the controller being configured to generate the control signal and to output the control signal to the actuator, the control signal being adapted to at least partially or completely cancel sound propagating inside the exhaust system when the actuator generates sound in the sound generator based on the control signal received from the controller, the controller being further configured to receive the signal indicating actuator overload or harm and in response to determine actuator overload or harm and based on the determination of actuator overload or harm at least one of:

to interrupt a generation of the control signal;

to interrupt an output of the control signal to the actuator; and to reduce a level of the control signal output to the actuator by at least 30%, wherein:

the actuator overload or harm sensor or indicator comprises a water sensor coupled to the controller and configured for being mounted in a region of a tail pipe of the exhaust system, the water sensor being configured to detect an immersion of the tail pipe into water and to output a corresponding signal to the controller; and the controller is configured to determine actuator overload or harm if the signal output by the water sensor indicates that the tail pipe of the exhaust system is immersed into water.

7. The sound propagation control system according to claim 6, further comprising an internal combustion engine, wherein the exhaust system comprises an exhaust structure located downstream of the internal combustion engine with respect to a flow of exhaust gas through the exhaust system, wherein the sound propagating through the exhaust structure is controlled via the controller.

8. The sound propagation control system according to claim 7, wherein the sound generator is located downstream of the internal combustion engine with respect to the exhaust gas flow.

* * * * *